US005388353A

United States Patent [19]

Givnan

[11] Patent Number: 5,388,353

[45] Date of Patent: Feb. 14, 1995

[54] CARD DISPLAY DEVICE

[76] Inventor: Virginia L. Givnan, 8175 SW Ernst Rd., Portland, Oreg. 97225

[21] Appl. No.: 106,443

[22] Filed: Aug. 16, 1993

[51] Int. Cl.[6] ..... G09F 1/10

[52] U.S. Cl. ..... 40/159

[58] Field of Search ..... 40/158.1, 159, 661

[56] References Cited

U.S. PATENT DOCUMENTS

| | | | |
|---|---|---|---|
| 2,508,854 | 5/1950 | Brodsky | 40/159 |
| 3,464,135 | 9/1969 | Eidinger | 40/661 |
| 3,879,875 | 4/1975 | Schneider | 40/159 |
| 4,196,536 | 4/1980 | Westberg | 40/159 |
| 4,896,027 | 1/1990 | Drexler | 40/159 |
| 4,944,968 | 7/1990 | Wagner | 40/159 |
| 4,958,450 | 9/1990 | Roberg | 40/159 |
| 5,000,319 | 3/1991 | Mermelstein | 40/159 |

FOREIGN PATENT DOCUMENTS

| | | | |
|---|---|---|---|
| 1548752 | 12/1968 | France | 40/159 |

*Primary Examiner*—John T. Kwon
*Assistant Examiner*—Mark Sgantzos
*Attorney, Agent, or Firm*—James D. Givnan, Jr.

[57] ABSTRACT

A display device including a transparent base having a plurality of card holders in place thereon. The holders include a transparent front face member and back joined in a yieldable manner to permit flexing for insertion and removal of the card or other article to be displayed. The holders are secured to the base by a spacer with an adhesive which does not alter the transparency of the holder and base to which it is secured. The front face member and back of each holder are joined by a flexible common edge which biases the face member toward the article displayed to retain same in place.

5 Claims, 1 Drawing Sheet

CARD DISPLAY DEVICE

BACKGROUND OF THE INVENTION

The present invention pertains generally to display devices for display of two dimensional articles.

A problem exists for the collectors and sellers of trading cards of the type having athletes pictured thereon along with a brief biography with their statistics on the back of the card. Further, handling of these cards greatly reduces their collector value which, depending on the pictured athlete, may be substantial. Trading of such cards is a common practice and accordingly permanent mounting of same in a picture frame is impractical.

SUMMARY OF THE PRESENT INVENTION

The present invention concerns a display device on which one or more items may be conveniently mounted and displayed in a manner permitting both sides of the items to be viewed.

A base of transparent material serves to support one or more holders each of which receives a sports card or the like. The holder has a biased member to confine the card in place. A transparent connector attaches the holder to the base and permits viewing of the front and back of the card (or other displayed article) without removal of the card from the device. A suitable holder is of clear plastic sheet material having a curved edge serving as a hinge about which a holder face may be flexed outwardly for card installation and removal.

Important objectives include the provision of a display device on which one or more cards may be permanently or temporarily mounted without hindering viewing of both sides of the card; the provision of a display device with both transparent card holders and attachment means for holding two dimensional items while permitting viewing of both sides of each item.

DETAILED DESCRIPTION OF THE PREFERRED EMBODIMENTS

Figure 1:
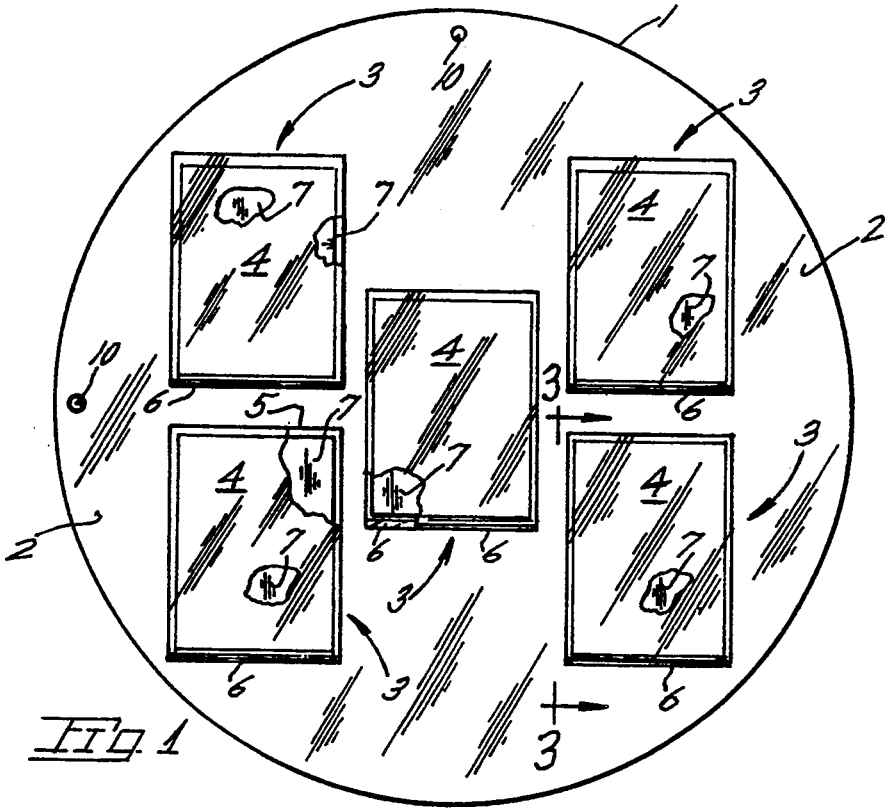
FIG. 1 is a front elevational view of the present display device.
Figure 2:
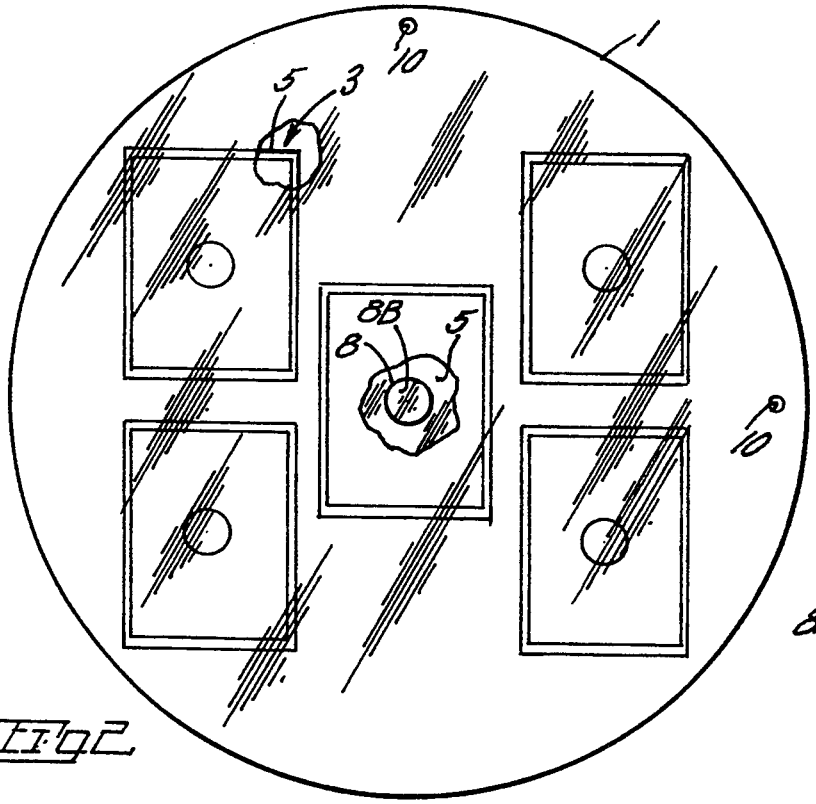
FIG. 2 is a rear elevational view of FIG. 1.
Figure 3:
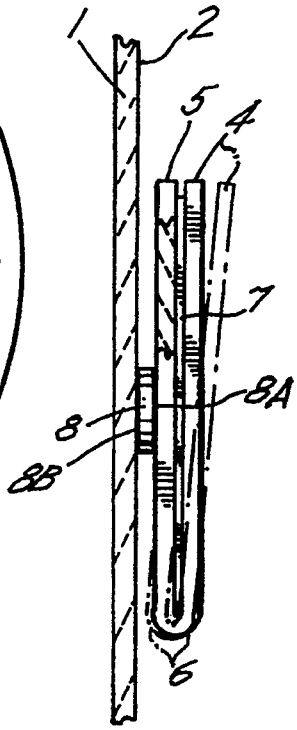
FIG. 3 is a vertical sectional view taken along line 3—3 of FIG. 1.

With continuing attention to the drawings the reference numeral 1 indicates a base of the present device which may be shown of other shape as for example the profile of a football when football sports cards are to be displayed.

A frontal surface 2 of the base carries one or more card holders generally at 3 which are of a transparent plastic such as acrylic sheet material. A face member 4 and a back 5 of each holder terminate in and are joined along an integral edge 6. The face member and back are formed so as to abut one another until momentarily spread apart or sprung by fingertip pressure for insertion of a sports card 7 or other two dimensional item to be displayed.

Attachment means at 8 is embodied in a spacer and is preferably of transparent material such as acrylic plastic and of disk or other shape treated with an adhesive on both sides 8A–8B for holder attachment to base surface 2. The attachment means is of transparent material and permits full viewing oft be card surface disposed toward transparent base 1. The attachment means are offset from holder edge 6 to facilitate flexure of face member 4 and back 5 during card installation and removal.

An opening 10 in the base permits convenient removal from a support permitting reversal of the base and hence viewing of the now outwardly facing remaining sides of the cards. Two openings at 10 assure the cards, as viewed, are right side up as at least some sports cards are printed in different directions on their two sides.

The preferred material for the present display device is clear acrylic plastic sheet material with the adhesive of the type not affecting the transparency of the surfaces to which it is applied. Acrylic sheet material for the holders,when one eighth of an inch or so thick, will flex under fingertip pressure along with integral edge 6 and back 5 to permit convenient card insertion and removal.

While I have shown but one embodiment of the invention, it will be apparent to those skilled in the art that the invention may be embodied still otherwise without departing from the spirit and scope of the invention.

Having thus described the invention, what is desired to be secured by a Letters Patent is:

I claim:

1. A display device for a card or a photograph comprising, a base of transparent material, a transparent card holder, attachment means attaching said holder to said base, said card holder including a transparent back and face member, means biasing the face member toward said back for engagement with a card in the holder to hold same in place, and said transparent base and said card holder permitting viewing of the front and rear sides of a card without removing same from the display device.

2. The device claimed in claim 1 wherein said attachment means includes an adhesive.

3. The device claimed in claim 1 wherein said attachment means comprises a spacer of transparent material adhesively attached to said holder and said base.

4. The device claimed in claim 1 wherein said holder comprises a back, a face member, said means biasing the face member comprising an edge integral with said back and face member, said attachment means offset from said edge to facilitate flexure of the face member for card installation and removal.

5. The display device claimed in claim 1 wherein said attachment means is transparent.

* * * * *